United States Patent [19]

Dameron

[11] 4,191,414

[45] Mar. 4, 1980

[54] SANITARY DEVICE

[76] Inventor: James Dameron, 2150 N. Racine, Chicago, Ill. 60614

[21] Appl. No.: 756,895

[22] Filed: Jan. 5, 1977

[51] Int. Cl.[2] ..... A47F 13/06

[52] U.S. Cl. ..... 294/1 BA

[58] Field of Search ..... 294/1 R, 19 R, 24, 51, 294/52, 55; 119/1 R; 15/236 R, 104.8, 257.1, 257.2, 105

[56] References Cited

U.S. PATENT DOCUMENTS

| | | | |
|---|---|---|---|
| 3,754,785 | 8/1973 | Anderson | 294/19 R |
| 3,767,246 | 10/1973 | Corelli et al. | 294/19 R |
| 3,810,670 | 5/1974 | Turi | 294/19 R |
| 3,819,220 | 6/1974 | Bredt | 294/19 R |

*Primary Examiner*—James B. Marbert

*Attorney, Agent, or Firm*—Laff, Whitesel & Rockman

[57] ABSTRACT

A sanitary device for pets comprising an elongated handle; a rigid triangular wire frame disposed on the end of the handle; and a disposable standard container bag removably mounted on the frame by means inter alia, of a bight adapted to secure the bag to the frame. The pet litter is scooped up into the container bag which is then removed from the frame and discarded for disposal purposes.

6 Claims, 2 Drawing Figures

SANITARY DEVICE

BACKGROUND OF INVENTION

In recent years, the public has shown an increasing concern about the health and aesthetic problems created by pet litter in urban areas. As a result, various sanitary devices have been designed in an attempt to provide an economical and efficient means of disposing of animal excrement. Most of these devices, however, do not provide an economical solution to this problem since they require the use of special disposable bags, frames and receptacles which are expensive. Accordingly, the present invention is designed to employ standard inexpensive plastic bags, of the type available at most supermarkets, for the collection of pet litter.

DETAILED DESCRIPTION OF THE INVENTION

Referring now in detail to the drawings, the sanitary device of the present invention comprises an elongated handle 10 having a substantially rigid wire frame 11 disposed on one end thereof. The wire frame 11 is in the configuration of a planar loop extending from handle 10. In the preferred embodiment, the wire frame 11 is substantially triangular in configuration, having the leg 16 furtherest from the handle 10 disposed perpendicular to the handle.

Figure 1:
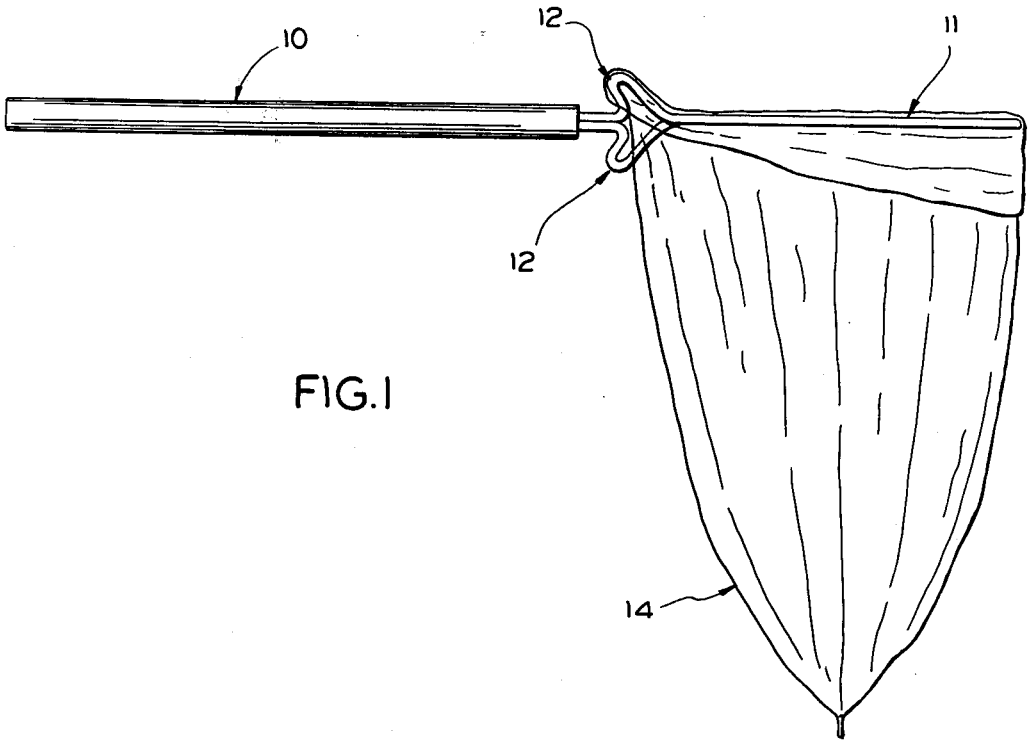
FIG. 1 is a side view in elevation of a device according to the present invention.
Figure 2:
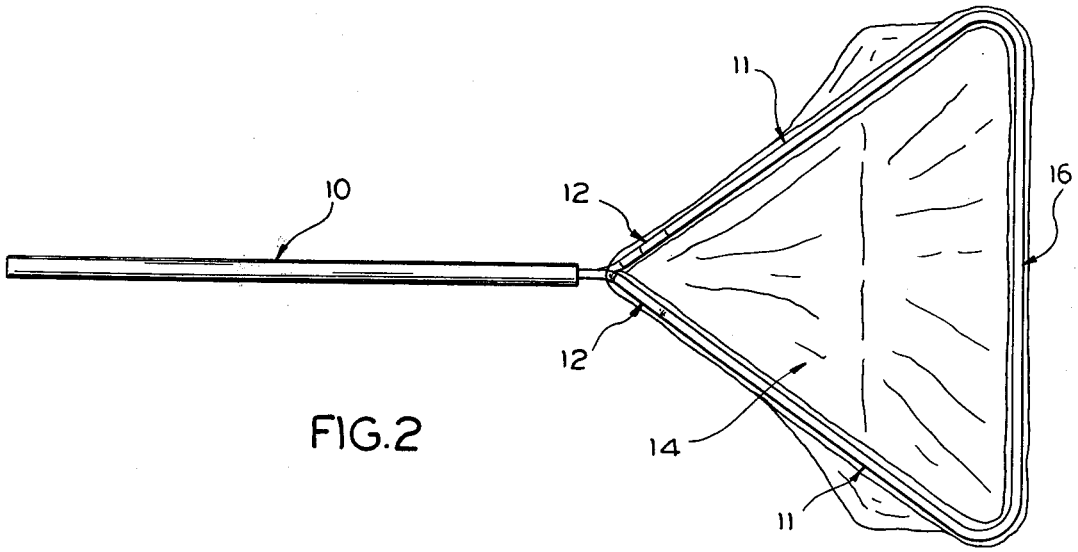
FIG. 2 is a plan view of a device according to the present invention.

The triangular wire frame 11 includes bight means 12 extending vertically from the plane of the wire frame 11 where the frame 11 joins handle 10. The bight means 12 provides a means to secure the plastic bag 14 to the frame, as will be explained, and to prevent the disposable bag 14 from slipping through the frame when the device is used to pick up pet litter. The bag 14 is a standard plastic bag such as are sold in supermarket and grocery stores. The bag needs no special fitting to enable use in the present invention. In the preferred embodiment, the bight means 12 curves rearwardly to a slight degree toward the handle 10 in order to enhance the frame's ability to effectively grip the disposable bag 14, although it has been discovered that a straight vertical bight will also hold a bag 14 securely. In the illustration (FIG. 1), bight means 12 includes two bights extending vertically upward and downward from the plane of wire frame 11. However, if desired, the device can be produced with a single vertically extending bight.

To use the novel sanitary device described above, the disposable plastic bag 14 is secured to the wire frame 11 by curling the periphery of the open end of the bag around the frame 11, including the vertical bight 12. The bight secures the upper rim of the bag 14 by applying a stretching force to the bag's rim as it is curled over the frame 11. This stretching force keeps the plastic bag secured to the frame when the device is used to scoop animal waste.

The handle 10 is formed by extending the wire forming frame 11 in a parallel manner from bight means 12. In the perferred embodiment, the extension of frame 11 forming handle 10 is covered with a plastic material.

In an additional embodiment of my invention, a long extension member can be used in connection with the frame 11 and handle 10 to enable a person to pick up the animal waste without bending over. To this end, the extension member would include a hollowed out portion at one end thereof, and the handle 10 would fit snuggly inside the hollow portion.

The present invention provides an inexpensive, convenient and easily manufactured device for removing animal excrement from the streets, sidewalks, parks and the like, using ordinary plastic bags which are sold in supermarkets and which require no special means to adapt them for use in the present invention. It is understood that the foregoing disclosure is given by way of illustrative example only, rather than by way of limitation, and that without departing from the invention, the details may be varied within the scope of the appended claims.

I claim:

1. A sanitary device for holding a commonly available plastic bag free of attachment means, comprising:

a wire frame disposed on one end of an elongated handle, said frame forming a planar loop at the end of said handle; bight means extending outwardly from the plane of said wire frame substantially near where the wire frame joins said handle; a disposable plastic bag removably mounted on said wire frame by folding the periphery of the open end of said bag around said frame and over said outwardly extending bight means, whereby said bight means causes said plastic bag to stretch tautly over said bight means and said wire frame securing said plastic bag to the wire frame.

2. The sanitary device of claim 1 wherein said planar loop is substantially triangular in configuration, with the leg of said triangle furtherest from said handle being disposed perpendicular to said handle.

3. The sanitary device of claim 1 wherein said bight means includes two bights extending outwardly, in a plane perpendicular to the plane of said wire frame, from and on both sides of said wire frame.

4. The sanitary device of claim 1 wherein said bight means curve slightly rearwardly toward said handle to securely hold said plastic bag on said frame.

5. The sanitary device of claim 1 wherein said elongated handle is formed by extending said wire frame in a parallel manner from said bight means.

6. The sanitary device of claim 5 wherein said extension of said wire frame forming said handle is covered with a plastic material.

* * * * *